United States Patent [19]

Thomasson

[11] 4,453,643

[45] Jun. 12, 1984

[54] CRANES

[75] Inventor: William R. Thomasson, Houghton-le-Spring, England

[73] Assignee: Coles Cranes Limited, Sunderland, England

[21] Appl. No.: 291,865

[22] Filed: Aug. 10, 1981

Related U.S. Application Data

[63] Continuation of Ser. No. 041,834, May 23, 1979, abandoned.

[30] Foreign Application Priority Data

May 31, 1978 [GB] United Kingdom ..... 25104/78

[51] Int. Cl.[3] ..... B66C 23/06; B66C 23/36

[52] U.S. Cl. ..... 212/184; 212/262; 212/266

[58] Field of Search ..... 212/46 R, 46 A, 46 B, 212/55, 58 R, 59 R, 144, 184, 188, 189, 199, 200, 202, 203, 204, 255, 262, 264–268, 239, 240

[56] References Cited

U.S. PATENT DOCUMENTS

| | | | |
|---|---|---|---|
| 3,084,806 | 4/1963 | Staples | 212/188 X |
| 3,149,730 | 9/1964 | Mork | 212/188 |
| 3,491,897 | 1/1970 | Tax et al. | 212/203 |
| 4,053,060 | 10/1977 | Wilson | 212/189 |
| 4,141,455 | 2/1979 | Henderson | 212/188 |

FOREIGN PATENT DOCUMENTS

| | | | |
|---|---|---|---|
| 1247584 | 8/1967 | Fed. Rep. of Germany | 212/184 |
| 2215905 | 10/1973 | Fed. Rep. of Germany | 212/240 |
| 48-5146 | 1/1973 | Japan . | |
| 51-20354 | 2/1976 | Japan . | |
| 520182 | 4/1940 | United Kingdom . | |
| 788262 | 12/1957 | United Kingdom | 212/188 |
| 1036737 | 7/1966 | United Kingdom . | |
| 1054873 | 1/1967 | United Kingdom | 212/144 |
| 1145414 | 3/1969 | United Kingdom . | |

*Primary Examiner*—Johnny D. Cherry

*Attorney, Agent, or Firm*—Townsend and Townsend

[57] ABSTRACT

Described herein are cranes and particularly those which are stability balanced, normally mounted on a truck or similar vehicle and provided with a boom of telescoping sections. The crane according to the invention has a boom provided with an upper lattice extension and a fly jib, attached (preferably pivotally), to the boom adjacent the top thereof or to the lattice extension at a point on the lower half of the extension. As this arrangement provides a reasonable length of boom, or lattice extension thereof, above the connection point of the fly jib, a substantial moment arm is provided enabling a relatively long and heavy fly jib to be employed giving greater stability to the top portions of the crane. Also the arrangement enables increased lift capability, at comparable radii, as compared with a standard crane, or similar lift capabilities at an increased working radius.

2 Claims, 5 Drawing Figures

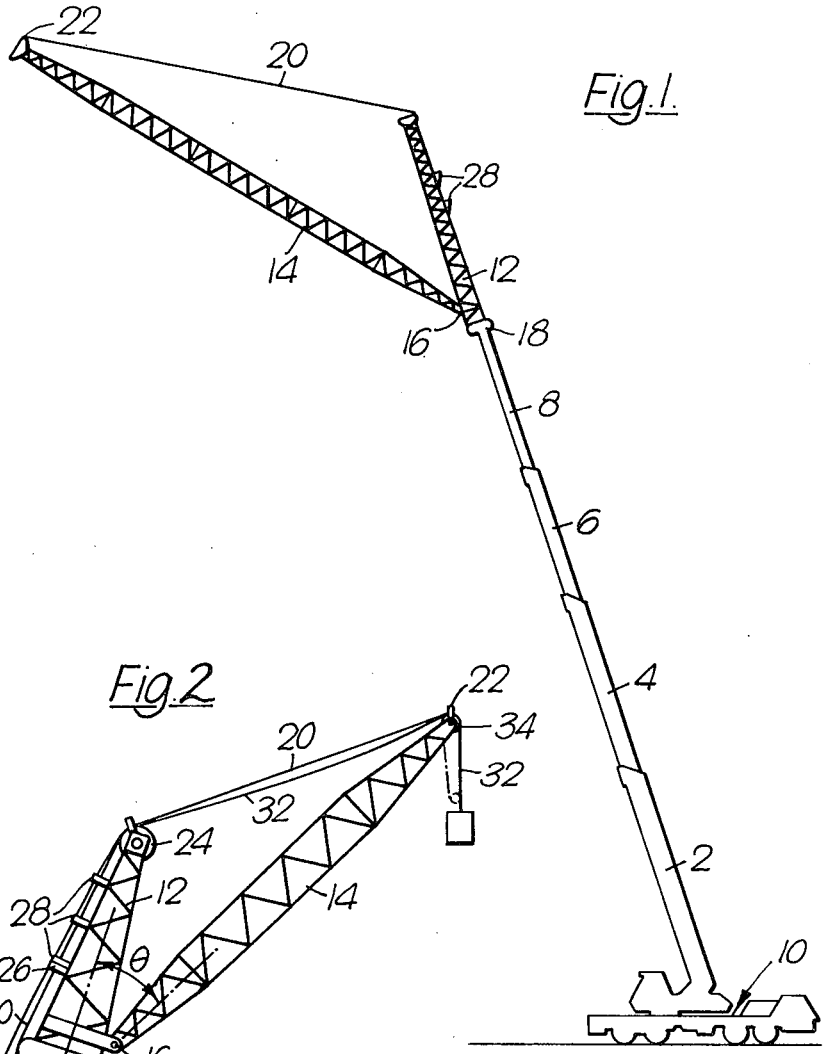
Fig. 1.
Fig. 2
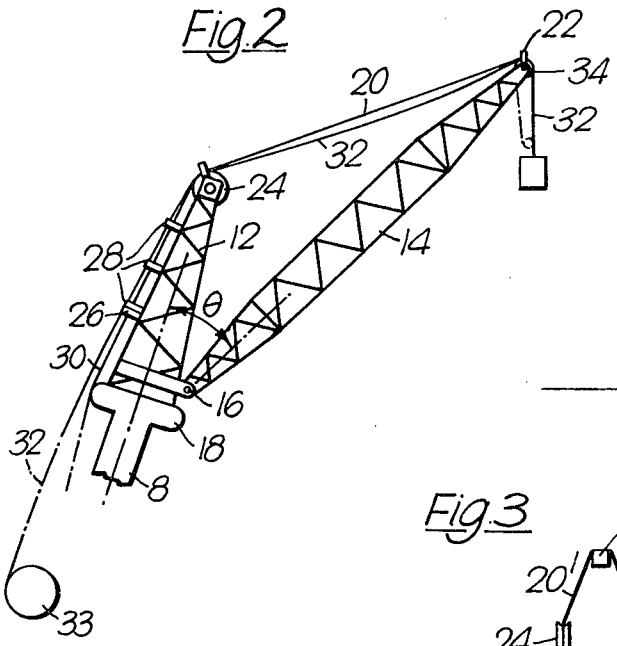
Fig. 3
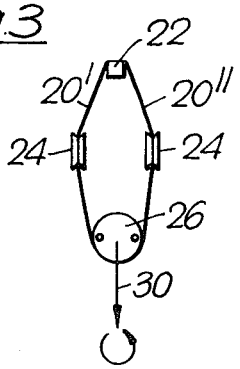

CRANES

This is a continuation of application Ser. No. 041,834, filed May 23, 1979, now abandoned.

This invention relates to cranes and in particular to cranes of the type which are stability balanced and are normally mounted on a truck or similar vehicle and provided with a boom of telescoping sections.

A problem arises with such cranes in that if the boom is made too long, and if it operates at too great a radius from the truck, then the weight of the truck or the like may not be sufficient to balance the load to be lifted. For this reason any fly jib provided for the crane is normally made as light in weight as possible, but this leads to problems in flexing and a feeling of insecurity for the operator and imposes a load lifting limit on the crane.

A crane in accordance with the invention has a boom provided with an upper lattice extension and a fly jib, attached (preferably pivotally), to the boom adjacent the top thereof or to the lattice extension at a point on the lower half of the extension.

Whilst the connection point may be at, or adjacent the top of the boom, it is preffered for the connection to be on the lattice extension adjacent the point of connection of the lattice to the top of the boom e.g. about 0.5 m above the top of the boom.

As this arrangement provides a reasonable length of boom, or lattice extension thereof, above the connection point of the fly jib, a substantial moment arm is provided enabling a longer and heavier fly jib to be employed giving greater stability to the top portions of the crane. Also the arrangement enables increased lift capability, at comparable radii, as compared with a standard crane, or similar lift capabilities at an increased working radius. Equally, the fly jib may be made longer than conventional jibs, e.g. it may be of a minimum length of about 15 m and a normal working length of say 25 m.

A crane of the invention preferably has telescopic boom sections and these may be retracted with the crane still giving a comparable height of lift to a conventional crane due to the increased jib length. If the telescopic sections are extended to give a greater lift height then again the crane has reasonable stability and greater lift capability and/or can work at a greater radius than a conventional crane.

The length of the fly jib is preferably at least two and a half times the distance of the pivot point, on the lattice extension, below the top of the lattice extension.

The angle between the jib and boom (or extension thereof) may be adjustable and, for example, may be 10°, 20° or 30° for fixed off-set work, or the jib may be luffed. For example twin tie ropes may be secured to the outer end of the jib and passed over twin sheaves secured at the top of the boom extension and then passed around a single pulley which may be pinned or otherwise secured to one of two or more brackets secured at varying distances down the boom or extension, depending upon the working jib angle required.

When it is desired to luff the jib, a rope may be secured to the pulley and passed around a standard hoist, drum or the like at the base of the crane boom.

The invention will now be further described by way of example with reference to the accompanying drawings in which:

FIG. 1 is a diagram illustrating one embodiment of crane in accordance with this invention, FIG. 2 is a diagram of the head of a crane similar to that illustrated in FIG. 1 showing an arrangement for fixing the fly jib at different angles to the crane boom, FIG. 3 is a sketch of the rope arrangement of FIG. 2, FIG. 4 is a sketch of the crane of FIG. 2 which shows the crane in a different position; and FIG. 5 is a sketch of a crane constructed in accordance with the prior art and which is shown to facilitate a comparison of the crane of the present invention with prior art cranes.

DESCRIPTION OF THE PREFERRED EMBODIMENTS

Figure 5:
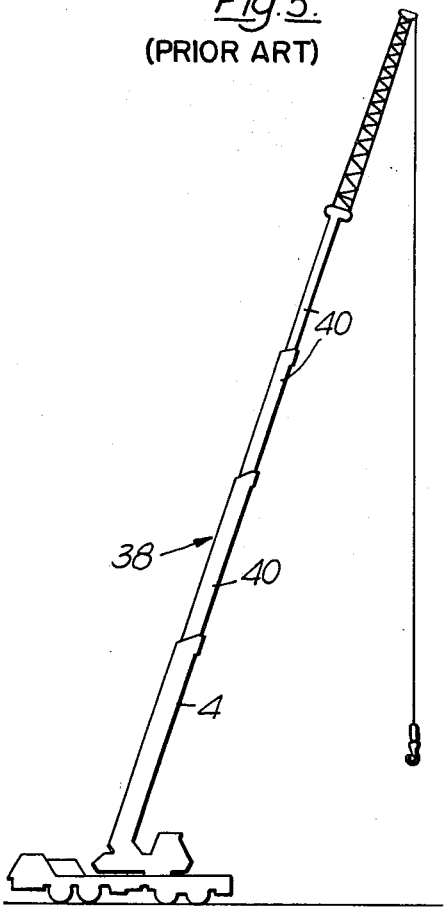
Fig. 5. (PRIOR ART)

The crane shown in FIG. 1 comprises a main boom formed of four telescoping sections 2,4,6 and 8, the section 2 being pivotally secured to a vehicle 10 in a standard manner to form a travelling or mobile crane. The uppermost telescopic section 8 which is of standard form, has an extension 12 of lattice work rigidly secured to it. A fly jib 14 of longer length than standard and also of lattice, is pivotally attached to the lattice extension 12 at a point 16 on the lower half of the extension just above the head 18 of the boom.

A tie rope (or ropes) 20 is secured to a bracket 22 at the outer end of the jib, passes over the head of the lattice extension and is secured thereto.

In the arrangement illustrated in FIGS. 2 and 3, it will be seen that a double tie rope 20 is used, the two lengths 20′, 20″ of which pass over twin sheaves 24 on the head of the lattice extension and then around a pulley 26 which may be secured to anyone of three brackets 28 on the lattice extension depending upon the required angle between the jib and boom for example 10°, 20° or 30°. This is convenient for fixed angle off-set work at any of these three (or more) angles.

When it is desired to luff the jib a rope diagrammatically shown at 30 is secured to the pulley 26 and is passed over a hoist drum or the like (not shown) at the bottom of the crane boom.

The normal hoist rope(s) 32 is passed over a sheave 34 at the end of the jib, around another sheave at the end of the extension (not shown) and down to a standard hoist shown diagrammatically at 33.

Figure 4:
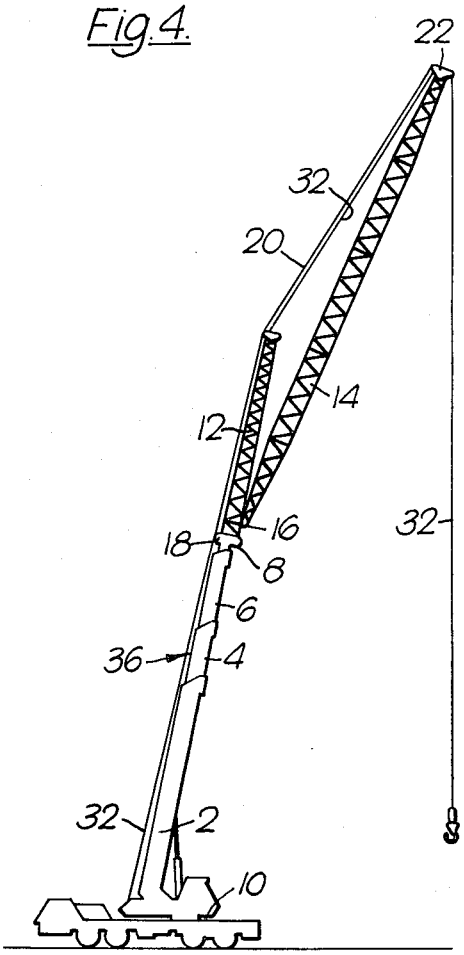

As an example the crane 36 in accordance with the invention shown at the right hand side of FIG. 4 has a main boom which is 18.3 m. long when contracted but is expandable to 33.2 m. with a lattice extension 12 which is 10 m. long. The fly jib 14 is 25 m. long and is secured to the lattice extension at a pivot point 16 which is located 0.4 m. above the head 18 of the boom. The jib is arranged for off-set work at a fixed angle of 10° to the crane boom (or lattice extension thereof).

The standard crane 38 illustrated in FIG. 5 has a main boom and lattice extension similar to the crane 36.

As can be seen, the lift height of the crane 36 with the boom sections contracted, is the same as the standard crane 38 illustrated in FIG. 5 with its telescopic boom 40 fully extended. Thus the crane 36 is stronger and more stable due to the fact that the proportions of the steel work of the top sections of the crane may be heavier and also due to the fact that the boom sections are contracted. Hence, the crane 36 is able to carry higher loads at a similar radius (e.g. the crane 36 can carry a load of 5,500 kg at a radius of 22 m. as compared with say 3,600 kg for the crane 38 at the same radius). If the boom sections are extended the crane 36 can carry 2,200 kg at a radius of 32 m. which cannot be achieved by the standard crane 38. Further if the angle of the jib to the boom is increased to 30° it can still carry 4,000 kg at a radius of 22 m. or alternatively, it can carry loads of say 2,000 kg at a radius of 36 m.

I claim:

1. A crane comprising a boom terminating in a boom top, a lattice extension connected with the boom top, a fly jib pivotally connected to the lattice extension adjacent the boom top, a double tie rope connecting an outer end of the jib to the lattice extension, the rope passing around first and second sheaves mounted at a top of the lattice extension, a pulley for engaging a portion of the double tie rope proximate the lattice extension, and a plurality of brackets attached at spaced apart locations to the lattice extension and adapted to mount the last mentioned pulley, whereby the mounting of the pulley to differing brackets causes a corresponding angular movement of the jib relative to the extension.

2. A crane as claimed in claim 1 including a hoist rope operatively coupled with the last mentioned pulley for luffing the jib and thereby angularly moving it relative to the extension.

* * * * *